US006227006B1

(12) United States Patent
Pantet

(10) Patent No.: US 6,227,006 B1
(45) Date of Patent: May 8, 2001

(54) WEAR-RESISTANT BRACELET

(75) Inventor: Laurent Pantet, Nods (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/210,369

(22) Filed: Dec. 14, 1998

(30) Foreign Application Priority Data

Dec. 18, 1997 (CH) ..... 2914/97

(51) Int. Cl.[7] ..... A44C 5/00

(52) U.S. Cl. ..... 63/3; 63/4; 63/5.1; 63/11; 63/26; 63/28; 63/32; 63/34; 63/36; 59/79.1; 59/80; 59/82

(58) Field of Search ..... 63/3, 3.1, 4, 5.1, 63/9, 11, 26, 28, 29.1, 31, 32, 34, 36, 38, DIG. 3; 59/79.1, 79.3, 80, 82, 84, 85, 88, 89, 90

(56) References Cited

U.S. PATENT DOCUMENTS

| | | | | |
|---|---|---|---|---|
| 203,426 | * | 5/1878 | Cox | 63/11 |
| 272,829 | * | 2/1883 | Cockshaw | 63/3 X |
| 352,917 | * | 11/1886 | Granbery | 63/3 X |
| 484,934 | * | 10/1892 | Jacobson | 63/32 |
| 802,267 | * | 10/1905 | Chaumet | 63/3 X |
| 1,560,414 | * | 11/1925 | De Haan | 63/32 |
| 1,894,195 | * | 1/1933 | Pulver | 63/3 X |
| 1,927,038 | * | 9/1933 | Kane | 63/28 X |
| 2,526,134 | * | 10/1950 | Henry | 63/32 |
| 2,568,212 | * | 9/1951 | Backman | 63/32 X |
| 3,114,187 | * | 12/1963 | Wayne | 63/3.1 X |
| 3,539,379 | * | 11/1970 | Mayer | 63/32 X |
| 3,948,040 | * | 4/1976 | Tuppini | 59/82 |
| 4,259,850 | * | 4/1981 | Lalieu | 63/13 |
| 5,853,826 | * | 12/1998 | Starcke et al. | 63/32 X |

FOREIGN PATENT DOCUMENTS

| | | | | |
|---|---|---|---|---|
| 675669 | | 10/1990 | (CH) . | |
| 675670 | | 10/1990 | (CH) . | |
| 85 34 115 | | 4/1987 | (DE) . | |
| 252857 | * | 1/1948 | (FR) | 63/3 |
| 2245476 | * | 1/1992 | (GB) | 63/3 |

* cited by examiner

*Primary Examiner*—Brian K. Green
*Assistant Examiner*—Andrea Chop
(74) *Attorney, Agent, or Firm*—Griffin & Szipl, P.C.

(57) ABSTRACT

The links (8) forming the bracelet (6) are articulated one after the other via cylindrical bars (9), these bars and links being held together by a flexible tie (10). The link (8) is made of a mineral material whose hardness is equal to or greater than 7.5 Mohs.

15 Claims, 5 Drawing Sheets

WEAR-RESISTANT BRACELET

FIELD OF THE INVENTION

The present invention concerns a bracelet link, this bracelet being formed of a plurality of links articulated one after the other via cylindrical bars inserted between the links, the links and the bars being held together by at least one flexible tie which passes through holes made in these links and bars in the longitudinal direction of the bracelet.

DESCRIPTION OF THE PRIOR ART

A tie attaching the links of a bracelet to each other via cylindrical bars inserted between the links is known from the Utility Model DE-G-85 34 115.0. This document discloses a bracelet-watch formed of links with concave flanks and transverse holes. This bracelet is also formed of bars of circular section encased in the concave flanks of said links. A cable passes through holes arranged in these links and bars to hold them together. This document does not however mention or suggest that the links forming the bracelet could be made of a mineral material as will be seen in the present invention.

The document CH-A-675 669 discloses a bracelet-watch including articulated links made of composite or mineral material. The bracelet also includes bracelet links connected to each other by linking elements pivotably mounted at each end on pins mounted in the bracelet links. The ends of the linking elements are arranged within a central opening made in each of the bracelet links. The ends of the linking elements have a semi-circumferential shape and the upper and lower faces include concavities. The lower horizontal face of the central rectangular opening includes rounded cutting edges on either side. Besides the fact that the bracelet of this document does not include any flexible tie holding the links together, one can imagine the great difficulty that there would be in manufacturing a link made of mineral material with a central opening and which, moreover, is pierced with four holes.

In order to overcome the aforecited drawback, there has been proposed a link formed of a base element onto which a decorative plate made of a mineral material is glued, as is describes for example in the document CH-A-636 994. In this document, the base elements, which can be made of metal, are articulated one after the other by conventional hinges using connecting bars, and the decorative plates can be made of glass or sapphire. In this case, there is no difficulty in producing simple plates made of a mineral material which is then affixed to a metal base element. However, this base element remains visible and the bracelet thus formed does not give the impression, as in the case of the present invention, of being made solely by means of links made of a mineral material.

SUMMARY OF THE INVENTION

Thus, the bracelet of the invention formed according to the first paragraph of this text is made of a mineral material whose hardness is equal to or greater than 7.5 Mohs.

BRIEF DESCRIPTION OF THE DRAWINGS

The invention will be understood now in the light of the following description and the drawings which illustrate it and which show by way of non-limiting example two embodiments of the link, drawings in which.

DESCRIPTION OF PREFERRED EMBODIMENTS

Figure 1:
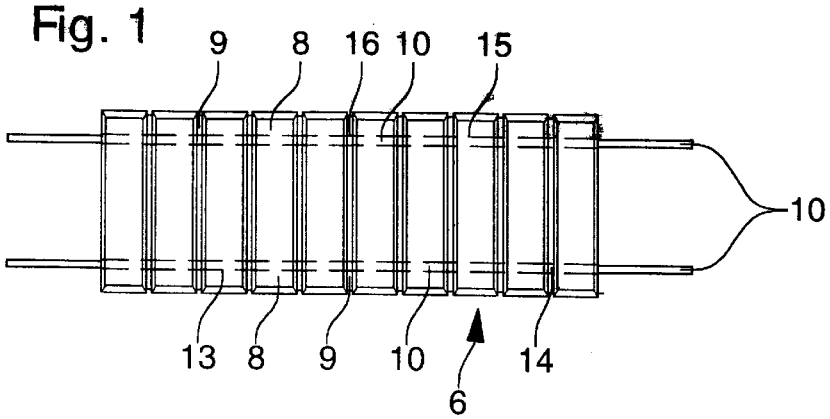
FIG. 1 is a top view of a bracelet portion using the link according to the invention.
Figure 2:
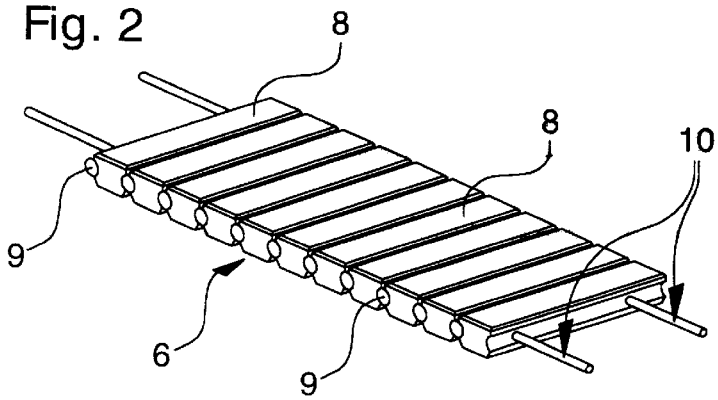
FIG. 2 is a perspective view of the bracelet portion shown in FIG. 1.

FIGS. 1 and 2 show, the first in plane and the second in perspective, a bracelet portion 6 using the link 8 according to the invention. This bracelet is formed of a plurality of links 8 articulated one after the other via cylindrical bars 9. Links 8 and bars 9 are held together by means of two flexible ties 10. Although this is not shown in FIGS. 1 and 2, it will be noted here that a single tie 10 could suffice. It will also be noted that ties 10 can be used, on one side of bracelet portion 6, for attaching the latter to a watch case and on the other side of said portion, for attaching the bracelet to an end link provided with means for fastening tie 10, this end link being able to be attached to, or to form part of a clasp. Flexible ties 10 pass through holes 13, 15 arranged in links 8 and holes 14, 16 arranged in cylindrical bars 9. Holes 13 and 14 are arranged in a line as are holes 15 and 16.

The invention is characterized in that links 8 which form the bracelet defined in the paragraph hereinbefore are made of a mineral material whose hardness is equal to or greater than 7.5 Mohs.

The Mohs scale of hardness, used especially in the jewelry industry, ranges from 1 (talc) to 10 (diamond). The hardness is measured by possible scratching made by different bodies of echelon hardness which act as a standard. A hardness of 7.5 is located between that of quartz which is 7 and that of topaz which is 8.

"Mineral material" means hard materials which are natural or artificial. In this category one can cite glass (~6 Mohs), quartz and materials of the same family (~7 Mohs) and artificially manufactured precious or semiprecious stones whose hardness ranges from 7.5 to 9 Mohs, like for example emerald (7.5 Mohs), spinel (8 Mohs), corundum, sapphire and ruby (9 Mohs). Consequently the use of metal, metal carbide or nitride, organic material or materials capable of causing allergies, such as nickel for example, are excluded.

The hardness of 7.5 Mohs envisaged here for the material forming the link is crucial. Indeed, one of the objects of the present invention is to propose a bracelet which is resistant to scratching by materials such as quartz or materials of equal or lower hardness (7 Mohs) than quartz. This limit is comprehensible if one knows that current dust can contain quartz and can thus rapidly alter the smooth and brilliant appearance which the bracelet has immediately after manufacturing, if it does not have greater hardness than that of quartz.

The bracelet concerned here includes an alternation of links 8 of great hardness and cylindrical bars 9, these bars allowing articulation of the links one after the other. One could however imagine the suppression of the bars, the flanks of the links being then formed to be articulated directly onto each other, as is disclosed for example in the document CH-A-467 598 wherein the links are directly articulated by the encasement of grooves and projections carried by the flanks of the links. Such an arrangement is however unthinkable when a hard mineral material is used for manufacturing the links. Indeed, the friction of one link on another would cause sooner or later nicking and grinding of the links. It is in order to avoid this drawback that two hard links of the present invention are separated from each other by a cylindrical bar to isolate them from each other. This bar is made of a much softer material than the material used to manufacture the link. A plastic material will preferably be used.

Figure 6:
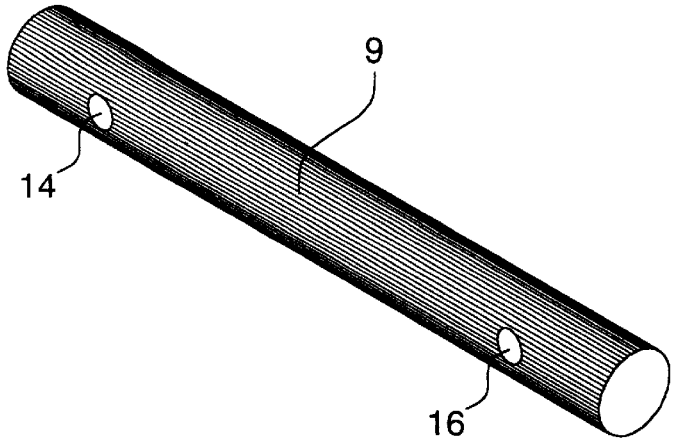
FIG. 6 is a perspective view of the bar forming the bracelet.
Figure 7:
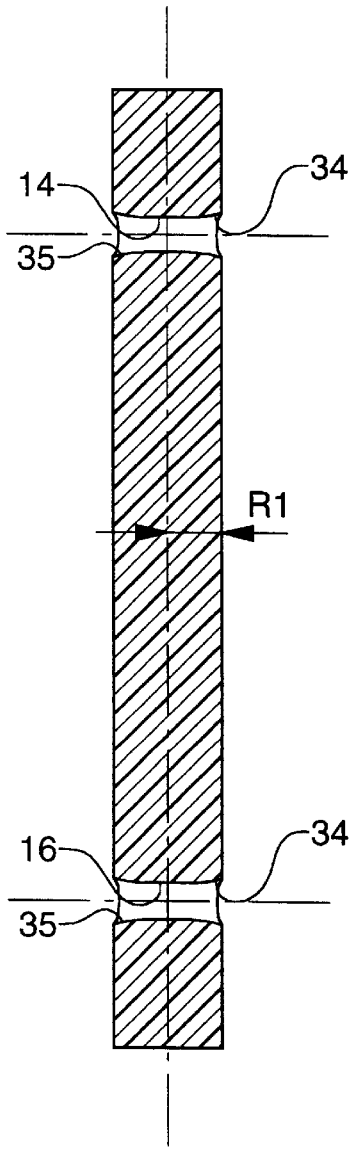
FIG. 7 is a cross-section along the length of the bar shown in FIG. 6.

The cylindrical bar 9 is shown in perspective in FIG. 6 and in longitudinal cross-section in FIG. 7. As the Figures show, bar 9 is pierced diametrically with two holes 14 and 16 into which passes tie 10 shown in FIG. 2. The same bar 9 will be used whatever the embodiment of the link, two of these embodiments being described hereinafter.

Figure 3:
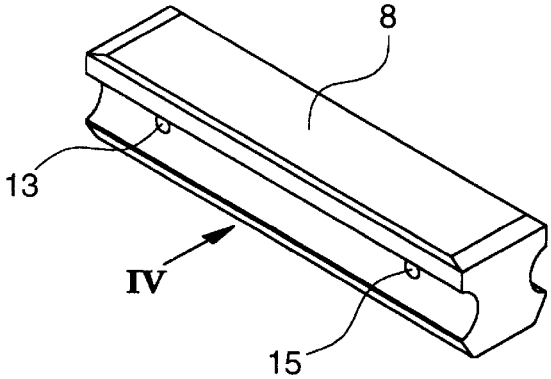
FIG. 3 is a perspective view of a first embodiment of a link according to the invention, this link being made in a single part.
Figure 5:
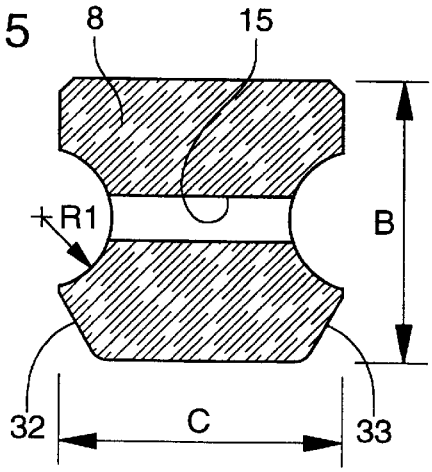
FIG. 5 is a cross-section along the line V—V of FIG. 4.
Figure 4:
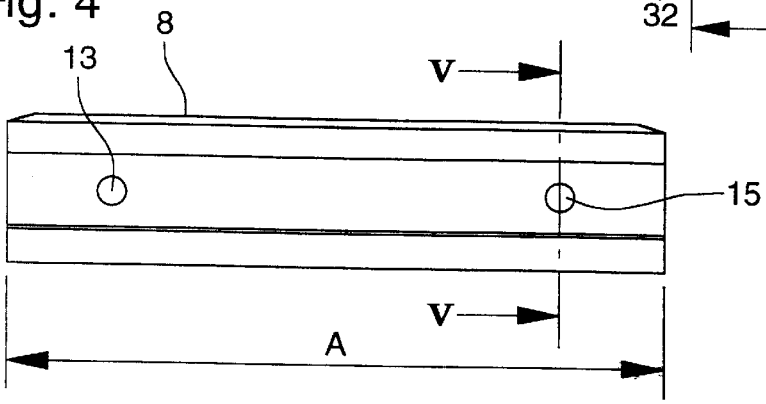
FIG. 4 is a view along the arrow IV of FIG. 3.

A first embodiment of link 8 is shown in FIGS. 3, 4 and 5. Here the link is made of a single part. It is pierced substantially at a mid-height position B (FIGS. 4 and 5) and in the longitudinal direction C of the bracelet, with two holes 13 and 15 through each of which a flexible tie 10 will pass once the bracelet is assembled. The Figures also show that flanks B of link 8 are provided with concavities of radius R1, which are dimensioned to accommodate a cylindrical bar 9 of the same radius R1 (see FIG. 7). FIG. 5 also shows that link 8 is provided with slight chamfers on the top and with skews 32 and 33 on the bottom. If the chamfers have a decorative purpose, skews 32 and 33 allow the bracelet to be bent downwards and wound around the wrist. The link machining operations can be performed by means of diamond tools in light of the great hardness of the material to be machined. It will be noted however that holes 13 and 15 could be made by laser or by ultrasound.

Figure 8:
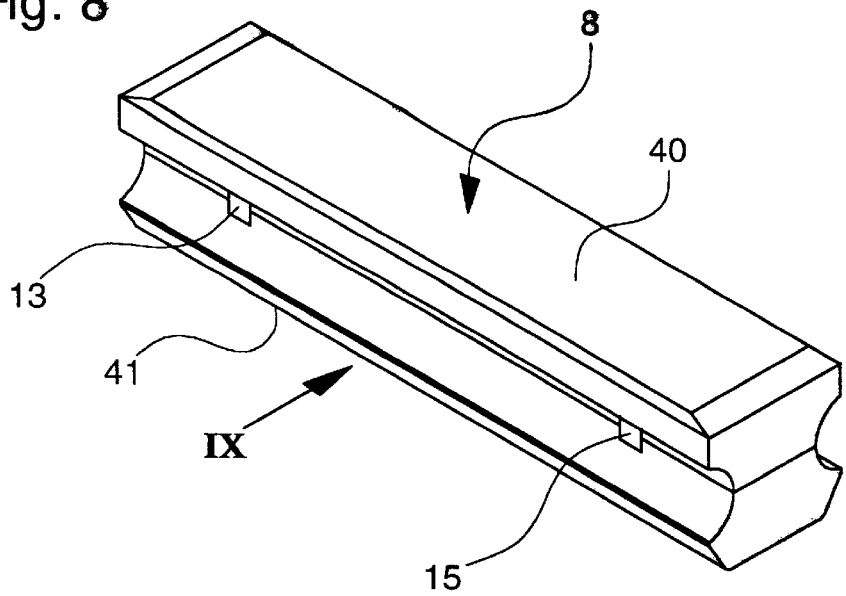
FIG. 8 is a perspective view of a second embodiment of the link according to the invention, this link being made in two parts, namely an upper plate and a lower plate.
Figure 9:
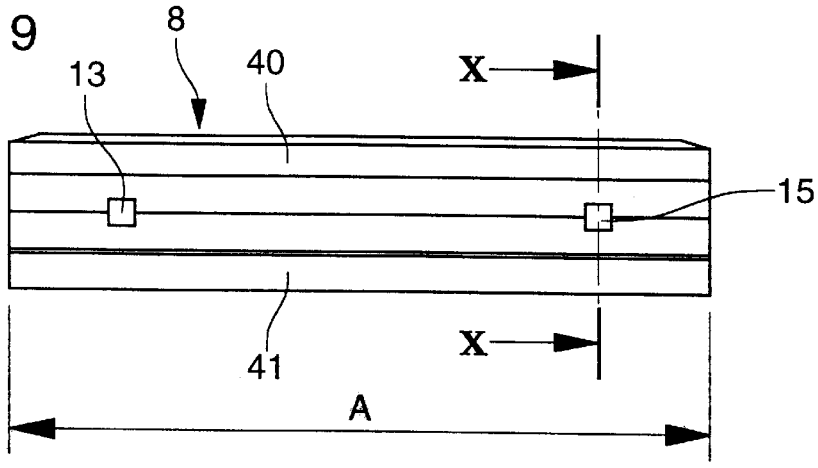
FIG. 9 is a view along the arrow IX of FIG. 8.
Figure 10:
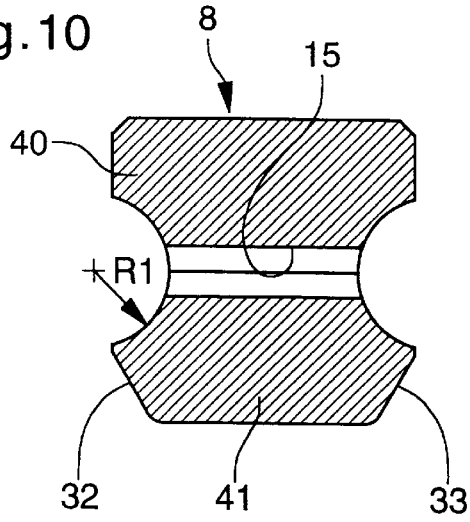
FIG. 10 is a cross-section along the line X-X of FIG. 9.
Figure 11:
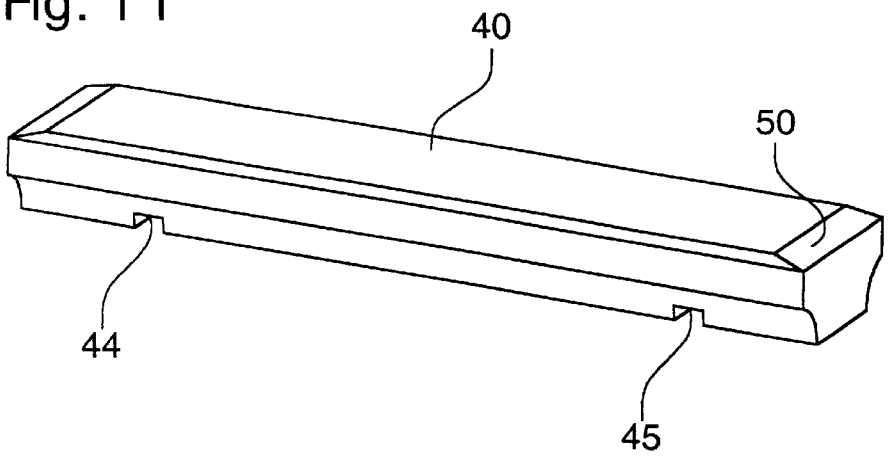
FIG. 11 is a perspective view of the upper plate forming the link of FIG. 8.
Figure 12:
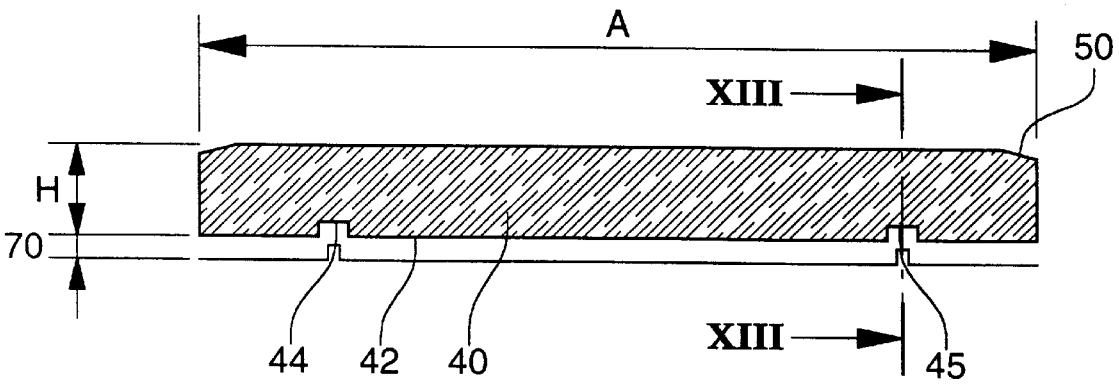
FIG. 12 is a cross-section along the length of the upper plate of FIG. 11.
Figure 13:
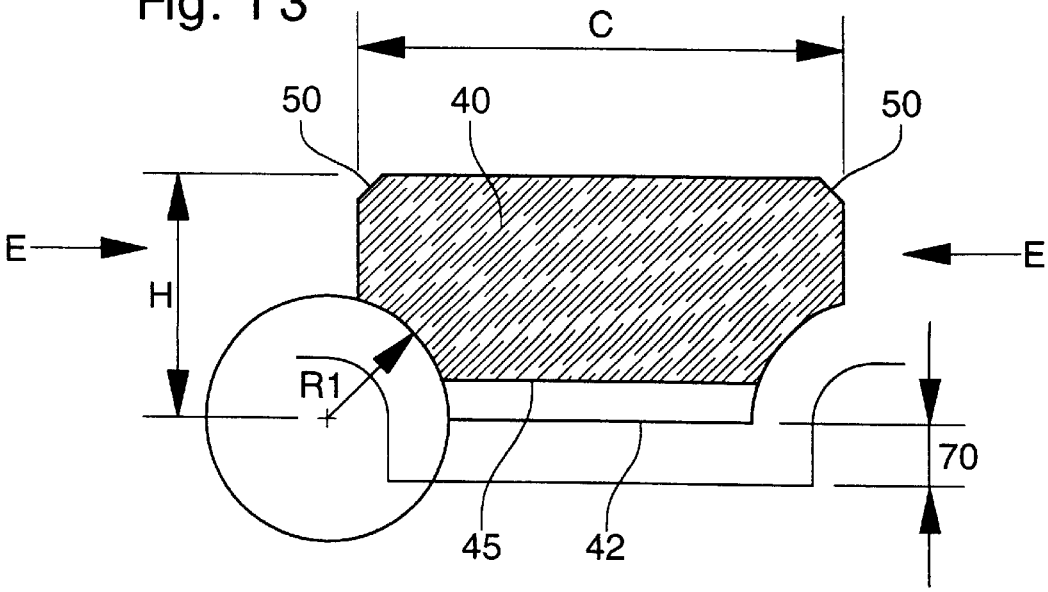
FIG. 13 is a cross-section along the line XIII—XIII of FIG. 12.
Figure 14:
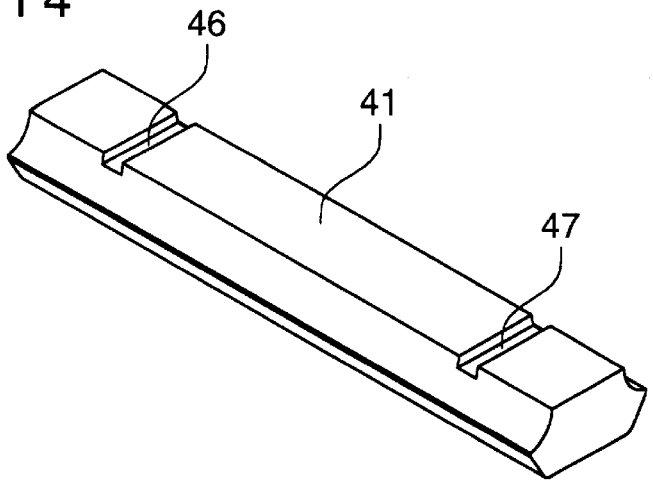
FIG. 14 is a perspective view of the lower plate forming the link of FIG. 8.
Figure 15:
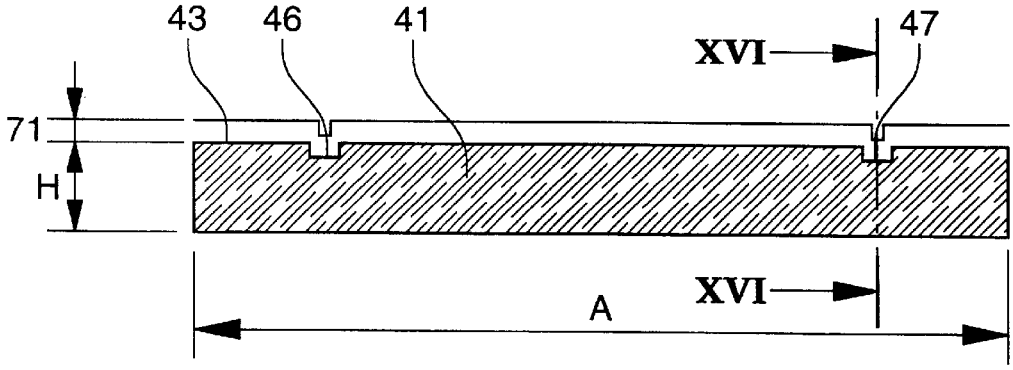
FIG. 15 is a cross-section along the lower plate of FIG. 14.
Figure 16:
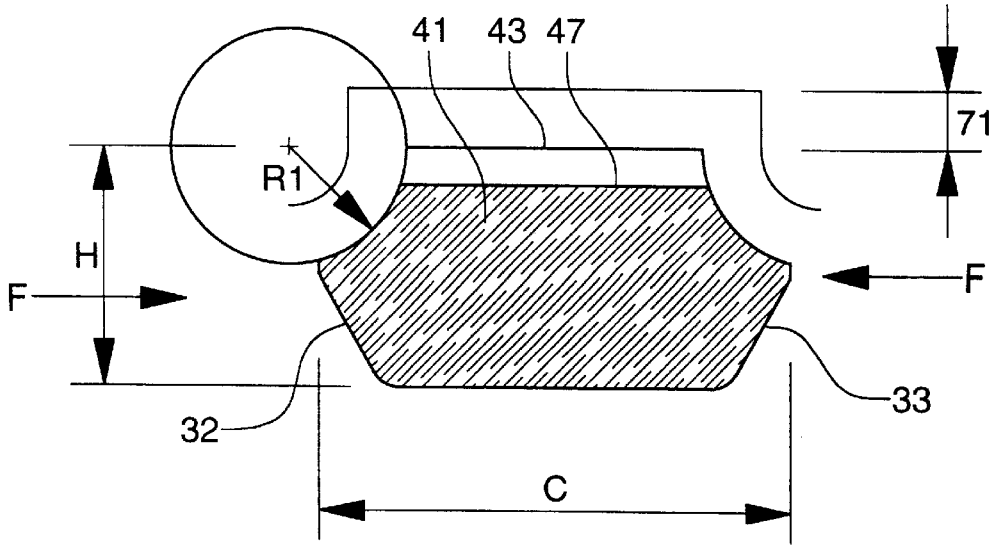
FIG. 16 is a cross-section along the line XVI—XVI of FIG. 15.

A second embodiment of link 8 is shown in FIGS. 8 to 16. Here the link is made in two parts, more specifically two superposed plates 40 and 41, of substantially equal height and extending in a plane perpendicular to the longitudinal direction of bracelet 6, as FIGS. 8, 9 and 10 show well. Upper plate 40 is detailed in FIGS. 11, 12 and 13 and lower plate 41 is detailed in FIGS. 14, 15 and 16. The lower face 42 of upper plate 40 and the upper face 43 of lower plate 41 are glued to each other to make the finished link 8 shown in FIGS. 8, 9 and 10. Lower and upper faces 42 and 43 defined hereinbefore each have two grooves referenced respectively 44, 45 and 46, 47. These grooves are arranged and dimensioned to form, when faces 42 and 43 are glued to each other, two holes 13 and 15 through each of which will pass a flexible tie 10 once the bracelet is assembled. The figures also show that flanks E of upper plate 40 (FIG. 13) and flanks F of lower plate 41 (FIG. 16) are provided with concavities of radius R1, which are dimensioned to accommodate a cylindrical bar 9 of the same radius R1 (see FIG. 7) once the bracelet is assembled. FIGS. 13 and 16 also show that upper plate 40 is provided with slight chamfers 50 on its upper periphery and that lower plate 41 is provided with skews 32 and 33 along its lower edges. As stated hereinbefore, with respect to the first embodiment, chamfers 50 have a decorative purpose whereas skews 32 and 33 allow the bracelet to be bent downwards and wound around the wrist.

This second embodiment of link 8 in two parts is advantageous since it allows the obligatory piercing operation of the first embodiment to be omitted, this operation being replaced by a grinding operation which is easier to implement.

This second embodiment has another advantage which, in the applicant's view, is crucial: the one which consists in coating with a thin layer of metallization both lower plate 40 and upper plate 41, as well as grooves 44, 45 and 46, 47 which are made therein. FIGS. 12 and 13 show a metallization 70 which covers lower face 42 of upper plate 40 as well as grooves 44 and 45. Likewise, FIGS. 15 and 16 show a metallization 71 which covers upper face 43 of lower plate 41, as well as grooves 46 and 47. It will be noted that in the figures the thickness of these metallizations 70 and 71 have been greatly exaggerated for obvious purposes of comprehension.

The advantage of the metallization is to give the link a colored appearance, for example black if black chrome is used, this appearance remaining resistant to deterioration, since the metallized faces, once glued together, are protected from any external influence (wear, scratching, etc.). It will also be understood that the colored appearance is combined with a brilliant appearance since the link is made of a very hard and transparent mineral material (for example transparent artificial sapphire). Yet another advantage of the metallization is that it hides ties 10 which pass into grooves 44, 45 and 46, 47, since these grooves are also metallized. Lastly, another advantage of the metallization is that it provides a layer for affixing the adhesive material allowing the two plates to be joined together. It will be noted that the thin layer of metallization can be deposited by a PVD (physical vapor deposition) or CVD (chemical vapor deposition) method. In summary, the link thus obtained has an attractive brilliant and colored appearance, this appearance being resistant to deterioration over time.

For the sake of completeness, it will also be noted that grinded portions R1 which will accommodate bars 9 once the bracelet is assembled, could be metallized to hide the bars connecting links 8 from view.

In order to manufacture link 8 in accordance with the second embodiment, as for link 8 according to the first embodiment, conventional equipment including diamond-tipped drills, diamond grinding wheels or saws will be used.

What is claimed is:

1. A bracelet being formed of a plurality of links and cylindrical bars said links being thicker than said bars, said links being provided with concavities dimensioned to accommodate the cylindrical bars and each cylindrical bar being disposed between two links, each cylindrical bar being substantially completely surrounded by the concavities of the two links between which each cylindrical bar is enclosed, the links and bars being held together by means of a flexible tie which passes through a hole made in each link and each bar in the longitudinal direction of the bracelet, wherein said links are made of a mineral material the hardness of which is equal to or greater than 7.5 Mohs and said bars are made of a softer material than the material used to manufacture said links.

2. A bracelet according to claim 1, wherein said links and said cylindrical bars each having a second hole, and a second flexible tie passing through said second holes made in each link and in each bar, said holes and said second holes being located substantially at mid-height of a thickness of said links and said bars.

3. A bracelet according to claim 1, wherein each link is made of the superposition of an upper plate and a lower plate of substantially equal height and extending in a direction perpendicular to the longitudinal direction of the bracelet, the upper plate having a lower face glued to an upper face of the lower plate, said lower and upper faces each having a groove, the groove in an upper plate and the groove in a lower plate forming said hole for the passage of said flexible tie.

4. A bracelet according to claim 3, wherein said lower faces and said upper faces and said grooves are covered by a thin layer of metallization.

5. A bracelet according to claim 4, wherein said layer of metallization is a layer of black chrome.

6. A bracelet according to claim 1, each of said links being made of a single part.

7. A bracelet according to claim 1 wherein said cylindrical bars are made of a plastic material.

8. A bracelet having a first side adapted to face outwardly from a wearer's wrist and a second side adapted to face a wearer's wrist when the bracelet is wrapped around the wearer's wrist said bracelet comprising a plurality of links and cylindrical bars, said links being provided with concavities in flanks thereof, said flanks and concavities extending perpendicular to a longitudinal direction of said bracelet, said concavities and said cylindrical bars having equal radii of curvature, each cylindrical bar being disposed between two links, the links and bars being held together by means of a flexible tie passing through a hole extending through each link and each bar in the longitudinal direction of the bracelet, said links comprising a mineral material the hardness of which is equal to or greater than 7.5 Mohs and said bars comprising a softer material than the material comprising said links, each of said flanks including first and second surfaces contiguous to the concavity provided therein, said first surface extending from the concavity toward said first side of the bracelet in a direction normal to the hole extending through the link and said second surface extending toward said second side of said bracelet, each said cylindrical bar being substantially completely surrounded by concavities of the two links between which each said cylindrical bar is disposed, whereby each said cylindrical bar is visible from said first side of the bracelet only through a narrow slot bounded by said first surfaces of the two links between which each said cylindrical bar is disposed.

9. A bracelet as claimed in claim 8 wherein the second surfaces are chamfer surfaces allowing said bracelet to be wrapped around a wearer's wrist.

10. A bracelet as claimed in claim 8, said links and said cylindrical bars each having a second hole, and a second flexible tie passing through said second hole in each link and in each bar, said holes and said second holes being located substantially at mid-height of a thickness of said links and said bars.

11. A bracelet as claimed in claim 8, wherein each of said links is made of the superposition of an upper plate and a lower plate of substantially equal height and extending in a direction perpendicular to the longitudinal direction of the bracelet, said upper plate having a lower face glued to an upper face of the lower plate, said lower and upper faces each having a groove, the groove in an upper plate and the groove in a lower plate forming said hole for the passage of said flexible tie.

12. A bracelet as claimed in claim 11, wherein said lower faces and said upper faces and said grooves are covered by a thin layer of metallization.

13. A bracelet as claimed in claim 11, wherein said layer of metallization is a layer of black chrome.

14. A bracelet as claimed in claim 8, wherein each of said links consists of a single part.

15. A bracelet as claimed in claim 8, wherein said cylindrical bars are made of a plastic material.

* * * * *